US010563489B2

(12) United States Patent
Lakhani et al.

(10) Patent No.: US 10,563,489 B2
(45) Date of Patent: Feb. 18, 2020

(54) DOWNHOLE OIL WELL JET PUMP DEVICE WITH MEMORY PRODUCTION LOGGING TOOL AND RELATED METHODS OF USE

(71) Applicant: PCS FERGUSON, INC., Frederick, CO (US)

(72) Inventors: Rizwan Lakhani, The Woodlands, TX (US); Ramamurthy Narasimhan, The Woodlands, TX (US); Rohit Abraham Paul, The Woodlands, TX (US); Subrat K. Samantray, The Woodlands, TX (US)

(73) Assignee: PCS Ferguson, Inc., Frederick, CO (US)

( * ) Notice: Subject to any disclaimer, the term of this patent is extended or adjusted under 35 U.S.C. 154(b) by 261 days.

(21) Appl. No.: 15/634,738

(22) Filed: Jun. 27, 2017

(65) Prior Publication Data

US 2017/0370195 A1 Dec. 28, 2017

Related U.S. Application Data

(60) Provisional application No. 62/355,191, filed on Jun. 27, 2016.

(51) Int. Cl.

| | |
|---|---|
| ***E21B 47/12*** | (2012.01) |
| ***E21B 23/14*** | (2006.01) |
| ***E21B 43/12*** | (2006.01) |
| ***E21B 47/00*** | (2012.01) |

(52) U.S. Cl.

CPC ..... *E21B 43/124* (2013.01); *E21B 47/00* (2013.01)

(58) Field of Classification Search

CPC ..... E21B 43/12; E21B 43/124; E21B 47/12; E21B 23/14

See application file for complete search history.

(56) References Cited

U.S. PATENT DOCUMENTS

| | | | | |
|---|---|---|---|---|
| 3,866,679 | A * | 2/1975 | Laky | E21B 19/22 134/167 C |
| 6,543,538 | B2 * | 4/2003 | Tolman | E21B 33/124 166/284 |
| 7,114,572 | B2 * | 10/2006 | Batho | E21B 34/10 166/370 |
| 7,234,520 | B2 * | 6/2007 | Khomynets | E21B 43/124 166/106 |
| 7,597,143 | B2 * | 10/2009 | Giacomino | E21B 47/01 166/105 |
| 2018/0038176 | A1 * | 2/2018 | Shampine | B66D 3/04 |

* cited by examiner

*Primary Examiner* — Catherine Loikith
(74) *Attorney, Agent, or Firm* — Baker & McKenzie LLP

(57) ABSTRACT

A downhole assembly in a wellbore includes a production logging tool disposed in the wellbore and a jet pump device set in a bottom hole assembly uphole from the production logging tool. The jet pump has a central axis, and includes one or more internal components that are radially offset to allow a slickline to pass through the jet pump device. The slickline is configured to actuate the production logging tool. While the jet pump device is operating to produce fluids, the production logging tool is further reciprocated within the wellbore on the slickline to obtain measurements at various locations.

24 Claims, 5 Drawing Sheets

BLANKING APPLICATION

PRODUCTION APPLICATION

DOWNHOLE OIL WELL JET PUMP DEVICE WITH MEMORY PRODUCTION LOGGING TOOL AND RELATED METHODS OF USE

CROSS-REFERENCE TO RELATED APPLICATIONS

This application claims priority under 35 U.S.C. § 119(e) of U.S. Provisional Patent Application No. 62/335,191, filed Jun. 27, 2016, which is incorporated by reference herein in its entirety.

FIELD

Embodiments disclosed herein relate to the field of pumping engineering with specific reference to the use of downhole jet pumps for oil production and oil-well performance logging.

BACKGROUND AND SUMMARY

Jet pumps are used in the oil and gas industry in applications that have demanding environments. The wells being pumped usually contain sizable solid particles and cannot employ other forms of artificial lift. Thus, assessing the well performance over time often requires the use of jet pumps in tandem with logging equipment.

A Memory Production Logging Tool ("MPLT") is used to determine well performance parameters such as flowing bottom hole pressure, flow velocity etc. These parameters are measured at various depths in the oil well and the most critical locations are at the pump intake and at the well perforations. Many designs exist that enable taking measurements at and just below the pump intake. However, in order to measure parameters further downhole, up to the well perforations, the MPLT must be actuated from the surface by slickline or wireline. To attain accurate results, it is necessary to simulate the production conditions of the well. This requires the well to be drawn down by a suitable jet pump.

Traditional jet pumps lack the provision to accommodate and operate this dynamic version of MPLTs. Therefore, a specialized adaptation of conventional jet pumps or a similar principle of operation is needed in the industry.

In one aspect, embodiments disclosed herein relate to a downhole assembly in a wellbore including a production logging tool disposed in the wellbore and a jet pump device set in a bottom hole assembly uphole from the production logging tool, the jet pump device having a central axis, and comprising one or more internal components that are radially offset to allow a slickline to pass through the jet pump device, the slickline configured to actuate the production logging tool. While the jet pump device is operating to produce fluids, the production logging tool is further reciprocated within the wellbore on the slickline to obtain measurements at various locations.

In another aspect, embodiments disclosed herein relate to a jet pump device disposed within a bottom hole assembly in a well, the jet pump device including a main body having a communication port for transfer of fluid between an annular region formed between the bottom hole assembly and the main body, one or more internal components that are radially offset from a central axis of the jet pump device to thereby allow slickline to pass lengthwise through the main body and down to a production logging tool, and a hydraulically-actuated ball and plunger locking mechanism configured to secure the jet pump device inside the bottom hole assembly.

In yet another aspect, embodiments disclosed herein relate to a method of logging oil well production including installing a bottom hole assembly in a well, and installing a jet pump device and production logging tool in the well and setting in the bottom hole assembly, pumping a power fluid downhole and operating the jet pump device to pump fluid to the surface, and reciprocating the production logging tool and moving to various locations within the well to record measurements while the jet pump device is operating.

BRIEF DESCRIPTION OF THE DRAWINGS

The invention is illustrated in the accompanying drawings wherein.

DETAILED DESCRIPTION

Figure 1:
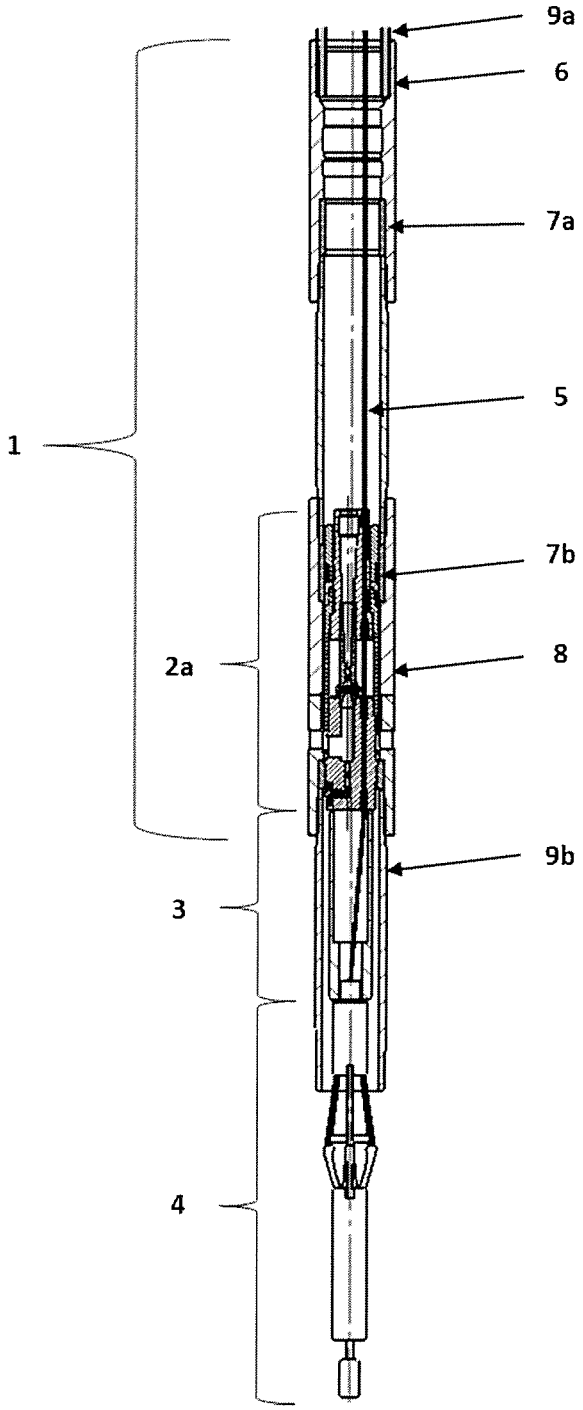
FIG. 1 illustrates a section view of a downhole assembly in accordance with one embodiment.

Embodiments disclosed herein relate to a downhole assembly for carrying out oil well production logging by leveraging the capabilities of downhole jet pumps. The various embodiments disclosed herein enable the production of crude oil from the well and well performance evaluation and logging, in addition to other downhole operations including, but not limited to, well intervention operations such as sludge removal and dewatering.

An MPLT may be lowered to the well perforation zone and reciprocated within the tube string along its length to be positioned at any depth. This is carried out either with the pumping device operating or, alternatively, with it off. First, a bottom hole assembly (BHA) is lowered on the tube string and set in place at the time of well installation. This BHA is an integral part of the tube string and as such, comes in contact with the crude oil from the perforations below it. Thus, the first step is completed. The next step is the preparation and lowering of the jet pump insert. The insert is assembled onto a slickline on the surface. When viewed in the order that they are lowered into the oil well, the slickline guide is attached below the insert followed by the MPLT itself. The whole assembly is lowered into the oil well on the slickline and it is seated in the BHA. The power fluid is then sent downhole from the surface and the jet pump starts pumping fluid to the surface. In the case of reverse flow of alternate embodiments, the power fluid actuates the locking mechanism and prevents the jet pump insert from becoming dislodged from the BHA.

Any type of jet pump may be used in accordance with one or more embodiments disclosed herein. Those skilled in the art will understand that jet pumps have no moving parts; the pumping action is achieved through energy transfer between two moving streams of fluid. The high-pressure power fluid, supplied from the surface, passes through a nozzle, where its potential energy (pressure) is converted to kinetic energy in the form of a very-high-velocity jet of fluid. Well fluids surround the power-fluid jet at the tip of the nozzle, which is spaced back from the entrance of the mixing tube. The mixing tube, usually called the throat, is a straight, cylindrical bore about seven diameters long with a smoothed radius at the entrance. The diameter of the throat is always larger than the diameter of the nozzle exit, allowing the well fluids to flow around the power-fluid jet and be entrained by it into the throat. In the throat, the power fluid and produced fluid mix, and momentum is transferred from the power fluid to the produced fluid, causing its energy to rise. By the end of the throat, the two fluids are intimately mixed, but they are still at a high velocity, and the mixture contains significant kinetic energy. The mixed fluid enters an expanding area diffuser that converts the remaining kinetic energy to static pressure by slowing down the fluid velocity. The pressure in the fluid is now sufficiently high to flow it to the surface from the downhole pump.

With no moving parts, jet pumps are rugged and tolerant of corrosive and abrasive well fluids. The nozzle and throat are usually constructed of tungsten carbide or ceramic materials for long life. Successful jet-pump adaptations have also been made for sliding side doors in both the normal and reverse-flow configurations. These are normally run in on wireline or as a fixed or conventional installation on continuous coiled tubing and have been successful in offshore drill stem testing (DST) of heavy-crude reservoirs. Other applications include the dewatering of gas wells.

With different sizes of nozzles and throats, jet pumps can produce wells at less than 50 barrels per day (B/D) or in excess of 15,000 B/D. To achieve high rates, a special BHA is required as the BHA itself is used as a crossover for the production, allowing for larger passages for the produced fluid to travel to the jet nozzle. As with all hydraulic pumping systems, a considerable range of production is possible from a particular downhole pump by controlling the power-fluid supply at the surface, but for any given size of tubing, the maximum achievable rates are usually much higher than those possible with stroking pumps. Significant free-gas volumes can be handled without the problems of pounding or excessive wear associated with positive-displacement pumps, or the inlet choking encountered in centrifugal pumps. The lack of vibration and the free-pump feature make them ideal for use with pumpdown pressure recorders to monitor bottomhole pressures (BHPs) at different flow rates.

Downhole jet pumps and well production logging are described in detail in US 2004/0071557, US 2004/0182570, US 2008/0314595, US 2009/0016900, US 2010/0032152, and US 2011/0000661, all of which are incorporated by reference here in their entireties.

While the jet pump is producing, the MPLT attached to the slickline can be reciprocated from the surface and moved to various locations along the tube string. The measurements are recorded and after the appropriate period of testing the MPLT is retrieved. The retrieval procedure is the reverse order of installation. The power fluid supply is halted and the MPLT is pulled back up to the level of the insert in the BHA. The whole assembly on the slickline is then pulled up from the BHA and to the surface where the well performance parameters can be retrieved.

Once production logging operations are complete, a blanking tool may be lowered in order to isolate the casing annulus from the tube string. Alternatively, a traditional production jet pump can be lowered to the BHA and full capacity production can be achieved. The insert can also be used as a production jet pump by plugging the respective slickline ports. Thus, the invention meets all requirements of oil well operation in a single, modular package.

The following description relates to a first embodiment of a downhole assembly illustrated in FIGS. 1, 2A, 2B, and 3. The downhole jet pump device that realizes the proposed method comprises three main systems as depicted in FIG. 1. The bottom hole assembly 1 is first lowered into the well at the time of well installation. It is comprised of a main body which has communication ports 15 (FIG. 2A) to connect the tube string 9*b* with the casing annulus. A top connector 6 connects the BHA to the tube string 9*a* and has a locking profile for traditional production jet pumps used in reverse flow configuration. There are two seal rings 7*a* and 7*b* that are assembled into the BHA. Seal ring 7*a* may be used to seal traditional jet pumps, while seal ring 7*b* may be used to seal the jet pump insert in accordance with one or more embodiments disclosed herein.

The second major component of the system is the jet pump insert 2*a* (FIG. 1). The jet pump insert is configured to allow for the passage of slickline 5 lengthwise through it in order to actuate the MPLT 4 downhole. The MPLT 4 may be kept at a distance from the insert 2*a* by using a slickline-spacer 3. The use of spacer 3 ensures that the slickline 5 is not kinked or twisted.

Figure 2B:
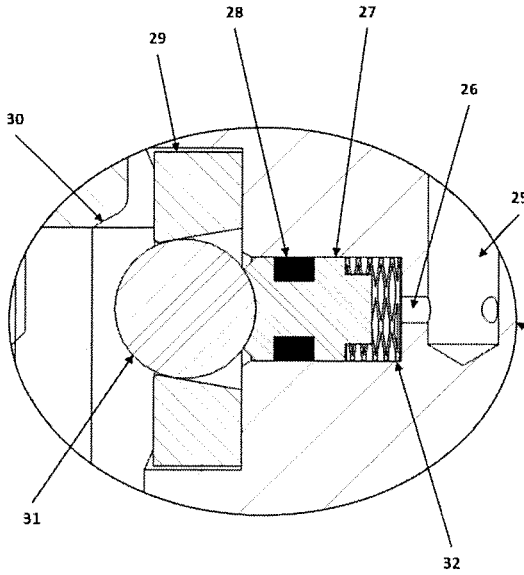
FIG. 2B illustrates an detailed section view of a retaining mechanism of the jet pump of FIG. 2A.
Figure 2A:
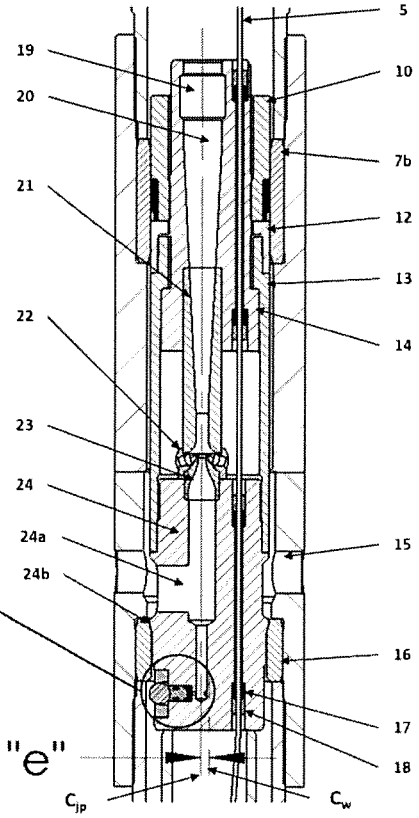
FIG. 2A illustrates an enlarged section view of a jet pump insert of the downhole assembly of FIG. 1.
Figure 3:
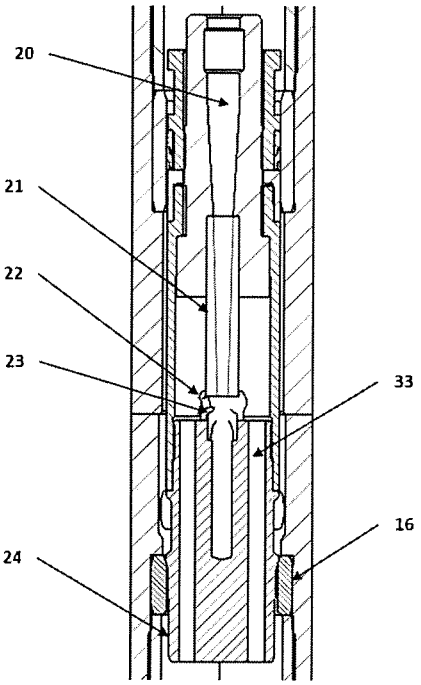
FIG. 3 illustrates an enlarged rotated section view of the jet pump insert of the downhole assembly of FIG. 1.

The jet pump insert 2*a* is further detailed in FIG. 2A. It comprises a main body 24 which has a communication port 24*a* for the transfer of power fluid from annular region formed between the BHA 1 housing 8 and the insert main body 24. The main body 24 also has a tapered seating face 24*b* that butts against ring 16 and seats such that the insert axis $C_w$ is coaxial to the BHA. The main body 24 seals and supports slickline 5 using packings 17 and bushings 18. Packings and bushings 17 and 18 may be used in all appropriate locations in the insert.

In an alternate plane that is rotated about axis $C_w$, insert main body 24 has ports 33 (FIG. 3) for well fluid entry into jet pump insert 2*a*. This allows crude oil to enter the pumping region to enable oil production to the surface.

Nozzle 23 is seated in main body 24 and further supports intake piece 22 above it. Intake piece 22 supports primary diffuser 21, and primary diffuser 21 seats inside secondary diffuser 20. The axis $C_{jp}$ of these components is offset from insert axis $C_w$ by distance "e". Secondary diffuser 20 performs additional functions which include support and sealing of slickline 5 using packings and bushings 17 and 18 and also has an internal profile 19 to allow for fishing operations when necessary.

Connecting tube 13 is attached to main body 24 at its lower end coaxial to $C_w$ while also ensuring the alignment of diffuser 21, intake piece 22, nozzle 23 and slickline 5. Components 12 and 10 are attached to connecting tube 13 and 14 respectively. They function to support and form the modular sealing elements between seal ring 7*b* and the jet pump insert 2*a*.

From the casing-tubing annulus, the power fluid enters the annular region formed between the BHA housing 8 and the insert main body 24 through port 24*a* and enters the channel leading to the nozzle 23 causing pumping of well fluid by suction through intake piece 22 and discharge through primary diffuser 21, into the secondary diffuser 20, past internal profile 19 and then into tube string above. Power fluid also enters the channel 25 (FIGS. 2A and 2B) and passes through port 26 into the locking chamber. The locking mechanism consists of spring 32, plunger 27, seal 28, retaining element 29 and ball 31. The power fluid entering through 26 actuates plunger 27 and causes it to positively engage 31 against 29. This ensures that 31 will come into contact with taper face 30 of 16 in case the insert 2*a* starts to move upwards and out of BHA 1. This positively locks insert 2*a* in place. On pump stoppage, pressure against 27 is relieved and 31 can apply sufficient force on 27 to compress 32 in order to retrieve insert 2*a* from BHA 1. Thus, the complete functioning of this invention is realized.

Figure 4:
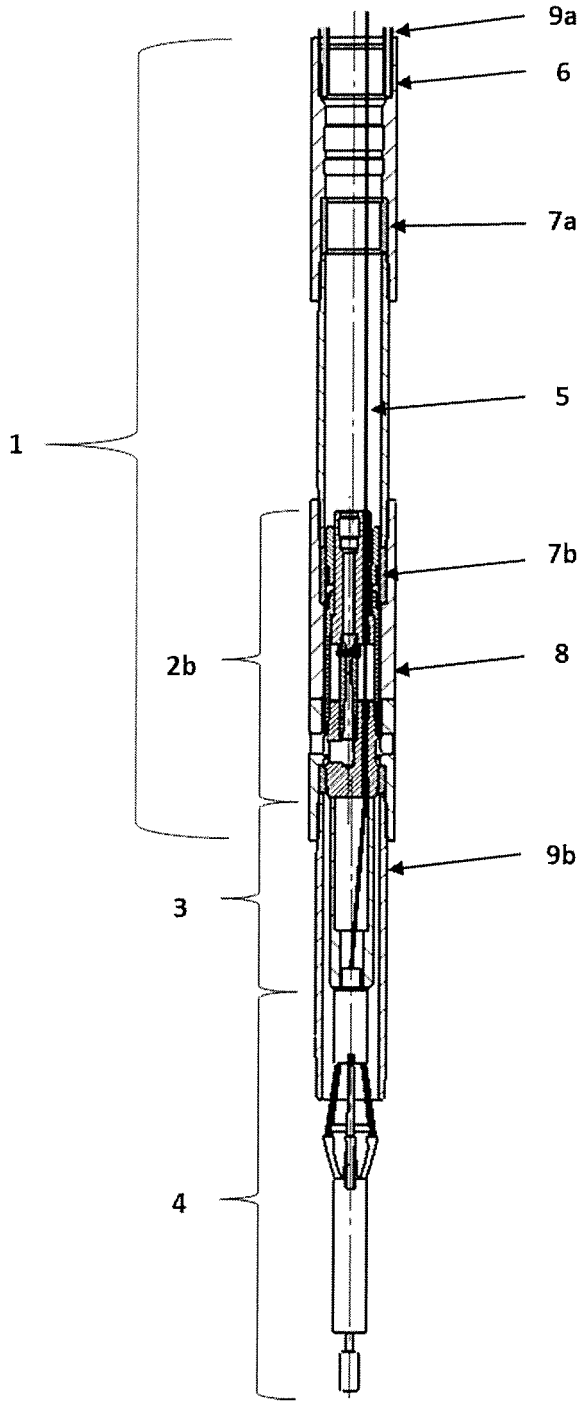
FIG. 4 illustrates a section view of a downhole assembly in accordance with an alternate embodiment.
Figure 5:
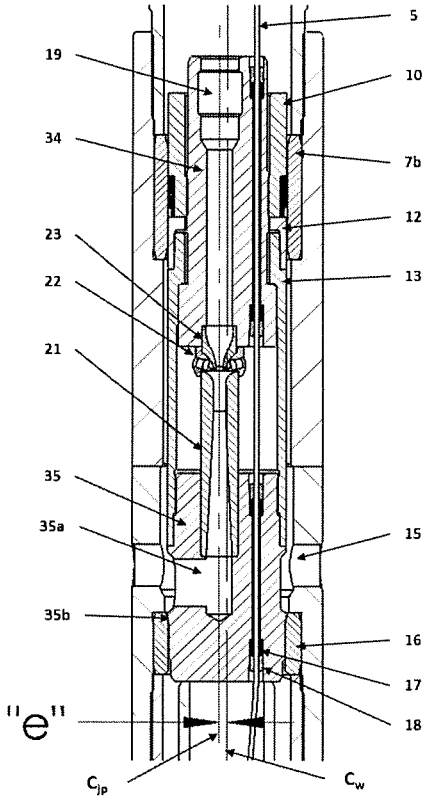
FIG. 5 illustrates an enlarged section view of a jet pump insert of the downhole assembly of FIG. 4.
Figure 6:
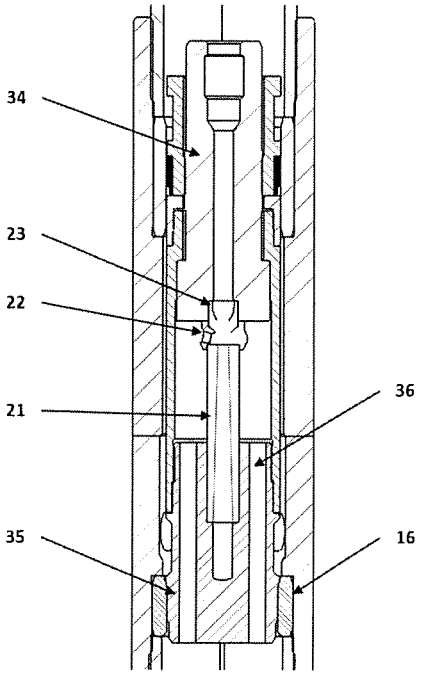
FIG. 6 illustrates an enlarged rotated section view of the jet pump insert of the downhole assembly of FIG. 4.

The following description relates to an alternate embodiment of a downhole assembly illustrated in FIGS. 4, 5, and 6. The BHA 1 remains the same as in the first embodiment. The method of utilization of MPLT 4 and slickline-spacer 3 remain the same. Many components and their functions remain similar to those mentioned in the embodiment described in reference to FIGS. 1, 2A, 2B, and 3.

The insert 2*b* is further detailed in FIG. 5. The housing 35 has a tapered seating face 35*b* that butts against ring 16 and seats such that the insert axis $C_w$ is coaxial to the BHA. The housing 35 seals and supports slickline 5 using packings 17 and bushings 18. Packings and bushings 17 and 18 may be used in all appropriate locations in the insert.

Nozzle 23 is seated in inlet housing 34 and further supports intake piece 22 below it. Intake piece 22 supports diffuser 21, and diffuser 21 seats inside housing 35. The axis $C_{jp}$ of these components is offset from insert axis $C_w$ by distance "e". Inlet housing 34 performs additional functions which include support and sealing of slickline 5 using packings and bushings 17 and 18, and also has an internal profile 19 to allow for fishing operations when necessary.

In an alternate plane that is rotated about axis $C_w$, housing 35 has ports 36 (FIG. 6), for well fluid entry into insert 2*b*. This allows crude oil to enter the pumping region to enable oil production to the surface.

Connecting tube 13 is attached to housing 35 at its lower end and holds inlet housing 34 coaxial to $C_w$ while also ensuring the alignment of diffuser 21, intake piece 22, nozzle 23, and slickline 5. Components 12 and 10 are attached to connecting tube 13 and 14 respectively. They function to support and form the modular sealing elements between seal ring 7*b* and the insert 2*b*.

The power fluid enters the inlet housing 34 past internal profile 19 and then enters the channel leading to the nozzle 23. Pumping of well fluid takes place by suction through intake piece 22 and discharge through diffuser 21, into housing 35. Housing 35 has a communication port 35*a* for the transfer of production fluid from the pumping area into the annular region formed between the BHA 1 housing 8 and the insert housing 35. From here the production fluid exits through port 15 and travels up through the casing-tubing annulus to the surface. Once logging operations are completed the insert 2*b* can be raised back to the surface by raising slickline 5.

Figure 7:
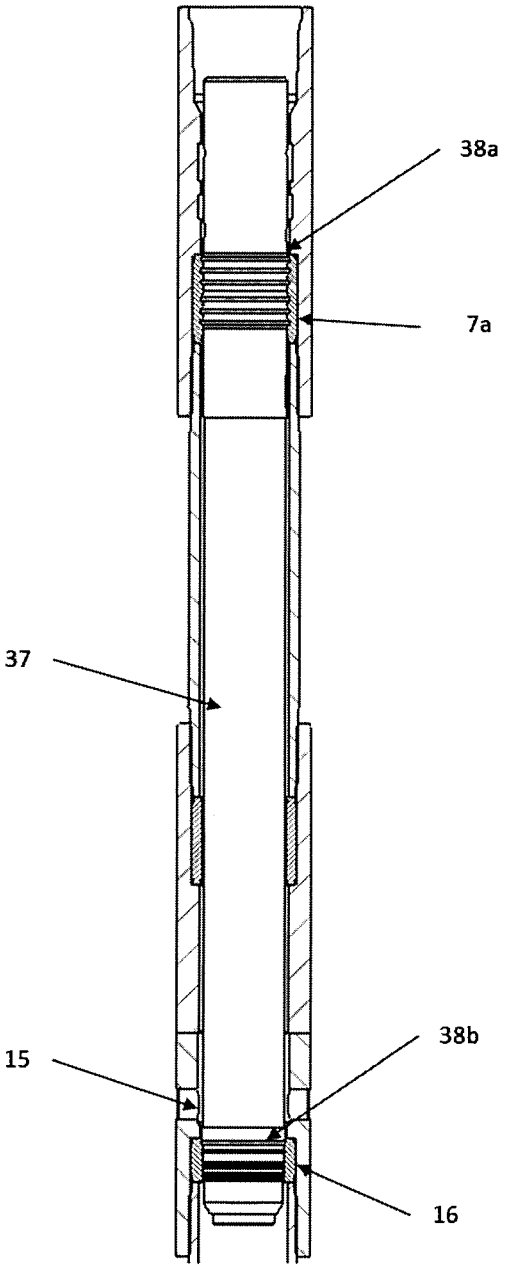
FIG. 7 illustrates a section view of a downhole assembly in a blanking application in accordance with one or more embodiments.

In order to cater to various well intervention applications, a blanking insert 37 may be lowered to the BHA 1 as shown in FIG. 7. The blanking insert seals at seal ring 7*a* and ring 16 using seals 38*a* and 38*b*. This ensures ports 15 are blocked and no communication can take place between the casing-tubing annulus and the tube string, thus achieving the desired function.

Figure 8:
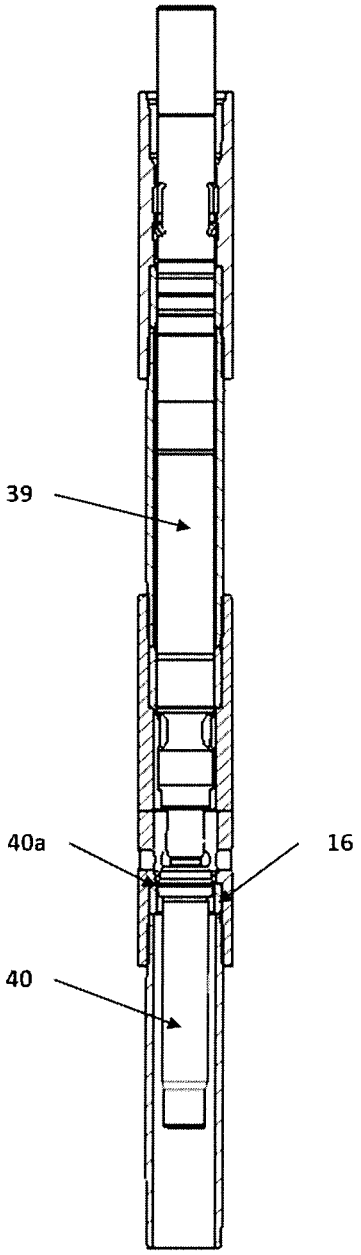
FIG. 8 illustrates a section view of a downhole assembly in a production application in accordance with one or more embodiments.

After logging operations are complete, a traditional jet pump 39 can be lowered to the BHA 1 to exploit full production capabilities as shown in FIG. 8. A standing valve 40 with seat 40*a* is lowered prior to that and seats against ring 16. Thus, the oil well can be drawn down to the maximum possible extent.

The claimed subject matter is not to be limited in scope by the specific embodiments described herein. Indeed, various modifications of the invention in addition to those described herein will become apparent to those skilled in the art from the foregoing description. Such modifications are intended to fall within the scope of the appended claims.

What is claimed is:

1. A downhole assembly in a wellbore comprising:

a production logging tool disposed in the wellbore; and a jet pump device set in a bottom hole assembly uphole from the production logging tool the jet pump device having a central axis, and comprising one or more internal components that are radially offset from the central axis to allow a slickline to pass through the jet pump device, the slickline configured to actuate the production logging tool, wherein, while the jet pump device is operating to produce fluids, the production logging tool is further reciprocated relative to the jet pump device within the wellbore on the slickline to obtain measurements at various locations.

2. The downhole assembly of claim 1, wherein the one or more radially offset internal components comprise a nozzle and one or more diffusers.

3. The downhole assembly of claim 1, further comprising a spacer axially disposed between the jet pump device and the production logging tool to ensure integrity and alignment of the slickline.

4. The downhole assembly of claim 1, wherein the jet pump device further comprises a locking mechanism configured to lock the jet pump device within the bottom hole assembly.

5. The downhole assembly of claim 4, wherein the locking mechanism comprises a hydraulically-actuated ball and plunger locking mechanism that secures the jet pump device inside the bottom hole assembly.

6. The downhole assembly of claim 1, wherein the jet pump device comprises a communication port for transfer of fluid between an annular region formed between the bottom hole assembly and the jet pump device.

7. The downhole assembly of claim 6, wherein fluid is configured to flow from the annular region and into the jet pump device.

8. The downhole assembly of claim 6, wherein fluid is configured to flow from the jet pump device and into the annular region.

9. The downhole assembly of claim 1, further comprising packings and bushings configured to support the slickline passing through the jet pump device.

10. The downhole assembly of claim 1, wherein the jet pump device pumps fluids uphole through a tube string.

11. A jet pump device operable to pump fluids uphole and disposed within a bottom hole assembly in a well, the jet pump device comprising:

a main body having a communication port for transfer of fluid between an annular region formed between the bottom hole assembly and the main body;

one or more internal components that are radially offset from a central axis of the jet pump device to thereby allow a slickline to pass lengthwise through the main body and down to a production logging tool, wherein while the jet pump device is operating to produce fluids, the production logging tool is further reciprocated relative to the jet pump device within the well on the slickline to obtain measurements at various locations; and a hydraulically-actuated ball and plunger locking mechanism configured to secure the jet pump device inside the bottom hole assembly.

12. The jet pump device of claim 11, wherein the one or more radially offset internal components comprise a nozzle seated in the main body.

13. The jet pump device of claim 11, wherein the one or more radially offset internal components comprise a first diffuser coupled to a nozzle, and a second diffuser coupled to the first diffuser.

14. The jet pump device of claim 11, wherein the production logging tool is disposed downhole from the jet pump device and is configured to be actuated and reciprocated within the well by the slickline.

15. The jet pump device of claim 11, further comprising packings and bushings configured to support the slickline passing through the main body.

16. The jet pump device of claim 11, wherein the jet pump device pumps fluids uphole through a tube string.

17. The jet pump device of claim 11, wherein a power fluid associated with the jet pump device actuates the hydraulically-actuated ball and plunger locking mechanism in a reverse flow application.

18. A method of logging oil well production comprising:

installing a bottom hole assembly and production logging tool in a well, and installing a jet pump device in the bottom hole assembly;

passing a slickline through the jet pump device at a radial offset from a central axis of the jet pump device;

operating the jet pump device to pump fluid uphole;

actuating the production logging tool with the slickline; and reciprocating the production logging tool relative to the jet pump device to various locations within the well to record measurements while operating the jet pump device.

19. The method of claim 18, further comprising pumping fluid from an annular region, formed between the bottom hole assembly and the jet pump device, into the jet pump device.

20. The method of claim 18, further comprising pumping fluid from the jet pump device into an annular region formed between the bottom hole assembly and the jet pump device.

21. The method of claim 18, further comprising raising the jet pump device to the surface after logging operations are complete.

22. The method of claim 21, further comprising installing a blanking insert in the bottom hole assembly.

23. The method of claim 21, further comprising installing a separate jet pump device to exploit greater production capabilities.

24. The method of claim 18, wherein the fluid travels uphole through a tube string.

* * * * *